United States Patent [19]

Simeth

[11] Patent Number: 4,611,538

[45] Date of Patent: Sep. 16, 1986

[54] INKING UNIT FOR A PRINTING MACHINE

[75] Inventor: Claus Simeth, Offenbach, Fed. Rep. of Germany

[73] Assignee: M.A.N.-Roland Druckmaschinen Aktiengesellschaft, Fed. Rep. of Germany

[21] Appl. No.: 690,668

[22] Filed: Jan. 11, 1985

[30] Foreign Application Priority Data

Jan. 12, 1984 [DE] Fed. Rep. of Germany ..... 3400831

[51] Int. Cl.[4] ..... B41F 31/04; B41F 31/14

[52] U.S. Cl. ..... 101/365

[58] Field of Search ..... 101/365, 350, 363, 207, 101/208, 209, 210, 148, 169, 157

[56] References Cited

U.S. PATENT DOCUMENTS 4,393,776 7/1983 Toyoda ..... 101/365

*Primary Examiner*—J. Reed Fisher

*Attorney, Agent, or Firm*—Leydig, Voit & Mayer, Ltd.

[57] ABSTRACT

An inking unit for a printing machine including a duct consisting of a plurality of adjacent duct segments mounted individually on the duct roller of the machine wherein each duct segment forms a carrier for at least some of the ink metering elements. The mounting of the duct segments on the duct roller is such that it substantially eliminates the hydrodynamic pressure forces occurring at the duct roller and the ink metering elements during operation. As a result, the duct roller deflection and the influence thereof on the metering gap are greatly reduced so that readjustment of the ink metering elements with respect to one another during operation can be dispensed with.

13 Claims, 4 Drawing Figures

INKING UNIT FOR A PRINTING MACHINE

FIELD OF THE INVENTION

The present invention relates generally to an inking unit for a printing machine and more particularly concerns a duct roller and a duct adapted to be set against the duct roller and having a plurality of ink metering elements the distance of which from the duct roller can be adjusted independently of one another.

BACKGROUND OF THE INVENTION

In various past inking units, in order to achieve zonewise dispensing of the film of ink produced on the duct roller, the individual ink dispensing or metering elements are so adjusted in respect of their distance from the duct roller as to form a metering gap which allows the required amount of ink to flow therethrough. Depending on the size of the gap, very high hydrodynamic pressure forces may occur between the ink metering elements and the duct roller. In zones with the smallest ink flow these pressure forces are of a value many powers of ten higher than zones with a considerably larger ink flow. Each additional adjustment of the ink metering elements therefore results in a different loading and deflection of the duct roller over the entire machine width so that accurate adjustment of the individual ink metering elements is time-consuming and difficult as they are repeatedly adjusted with respect to one another.

One known inking unit of this kind is disclosed in German Offenlegungsschrift No. 27 33 845, wherein a retaining block carries the ink metering elements in a duct extending over the entire printing machine width and has a stop or abutment which abuts the duct roller when the block is pressed against the duct roller. The stop abutment surfaces are of a curvature corresponding to the duct roller. This known system is intended to provide direct adjustment of the block and of the ink metering elements with respect to the duct roller and obviate any effects of the mounting of the duct roller and of the duct in the machine frame. However, deflection of the duct roller cannot be detected and compensated for with this system.

OBJECTS AND SUMMARY OF THE INVENTION

The primary aim of the present invention is to provide an inking unit of the kind referred to hereinbefore in which adjustment of the ink metering elements is no longer adversely affected by hydrodynamic pressure forces and the deflection of the duct roller.

To this end, according to the present invention, the duct consists of a plurality of adjacent duct segments mounted individually on the duct roller, each duct segment forming a carrier for some of the ink metering elements. This division of the duct into individual duct segments capable, as a result of their mounting, of following the duct roller deflection, reduces the effect of the deflection on the metering gap to such an extent that it is no longer necessary to repeatedly re-adjust the ink metering elements with respect to one another.

In one advantageous aspect of the invention, the mounting of the duct segments substantially eliminates the hydrodynamic pressure forces occurring at the duct roller and the ink metering unit during operation. The advantage of this aspect of the invention is that the duct roller deflection is greatly reduced because the effective bending length of the duct roller is reduced to the much smaller distance of the duct segment mountings. Since the magnitude of the characteristic deflection is determined by the fourth power of the bending length, this step according to the invention so reduces the duct roller deflection, even if the duct is divided into only four duct segments, that the deflection can be essentially disregarded for the ink metering element adjustment.

According to a further feature of the invention, a carrier duct is provided for mounting the duct segments, the carrier duct being mounted directly on the duct roller and the individual duct segments being secured on the carrier duct for limited pivotal movement. The resulting mounting allows the duct segments to be easily assembled and disassembled for initial installation and for subsequent maintenance or repair purposes. Also, to allow accurate alignment of the duct segments parallel to the duct roller, according to the invention, the mounting of the duct segments may be constructed so as to rock transversely of the pivoting axis.

Preferably, the duct roller carries bearing rings each situated adjacent the lateral ends of the duct segments, the carrier duct being flanged thereon, and the duct segments abut the bearing rings by adjustable stops. The result is a mounting which experiences little wear and which allows accurate adjustment of the duct segments relative to the duct roller. Advantageously, the bearing rings are disposed in grooves in the duct roller and their outside diameters in the region of the vibrator and of the ink metering elements do not exceed the outside diameter of the duct roller. In this way, a vibrator having a continuous roller can be moved up against the duct roller without obstruction. This construction of the bearing rings also simplifies the sealing of the duct segments relative to the duct roller in the region of the ink metering elements.

According to one embodiment of the invention, the duct roller consists of a continuous shaft and a plurality of tubular segments pushed on to the shaft and connected thereto so as to rotate therewith, each tubular segment cooperating with the ink metering elements of a duct segment, and a bearing ring is mounted loosely on the shaft on each of the two sides of the tubular segments. Advantageously, the axial clearance between the tubular segments and the bearing rings is adjustable by means of a clamp nut screwed on one end of the shaft, said nut cooperating with a shaft collar fixed on the other end of the shaft.

According to another embodiment of the invention, in order axially to secure the tubular segments on the shaft, a tubular segment disposed in the middle of the shaft may be connected to the shaft so as to be axially immovable and compression springs are clamped between the two outer bearing rings and abutment elements adjacent the rings and secured to the ends of the shaft. Consequently, the individual tubular segments and the bearing rings are pressed against one another so as to be free from axial play, since the tubular segment situated in the middle is fixed on the shaft. The advantage of this construction is that thermal expansion of the tubular segments can be taken up elastically. Another advantage of this construction is that the axial displacement of the tubular segments and of the duct segments connected to them via the bearing rings, due to thermal expansion of the tubular segments, is only half the total thermal expansion of the duct roller formed by all the tubular segments.

According to still another aspect of the invention, the duct segment mounting is advantageously achieved with compression springs clamped between the duct segments and the carrier duct and bias the duct segments, with the adjustable stops at their lateral ends, against the bearing rings of the duct roller. Consequently, the duct segments can follow movements or deformations of the duct roller without compulsive forces occurring or without the distance of the duct segments from the duct rollers changing. The prestressing of the spring system is advantageously selected so as to be greater than the maximum hydrodynamic pressure forces occurring at the ink metering elements.

In the preferred embodiment, the stops on the duct segments are formed by adjusting screws situated approximately in the same plane as the ink metering elements. The adjusting screws at the adjacent ends of two duct segments bear against the same bearing ring in slightly circumferentially offset relationship to one another. This gives a very compact construction so that the ink-free zones on the duct roller in the area of the bearing rings remain small.

Also, according to the invention, the carrier duct is fixed to the side frame of the printing machine by a cross-member which extends parallel to the duct roller and by means of which the carrier duct is fixed in respect of its position relative to the duct roller. Preferably, the duct roller tubular segments, the duct segments, and corresponding portions of the carrier duct are constructed as matching modules which can be strung together in any desired number to form different inking unit widths. With this construction it is possible to adapt the inking unit according to the invention to different machine widths with a minimum of different components.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
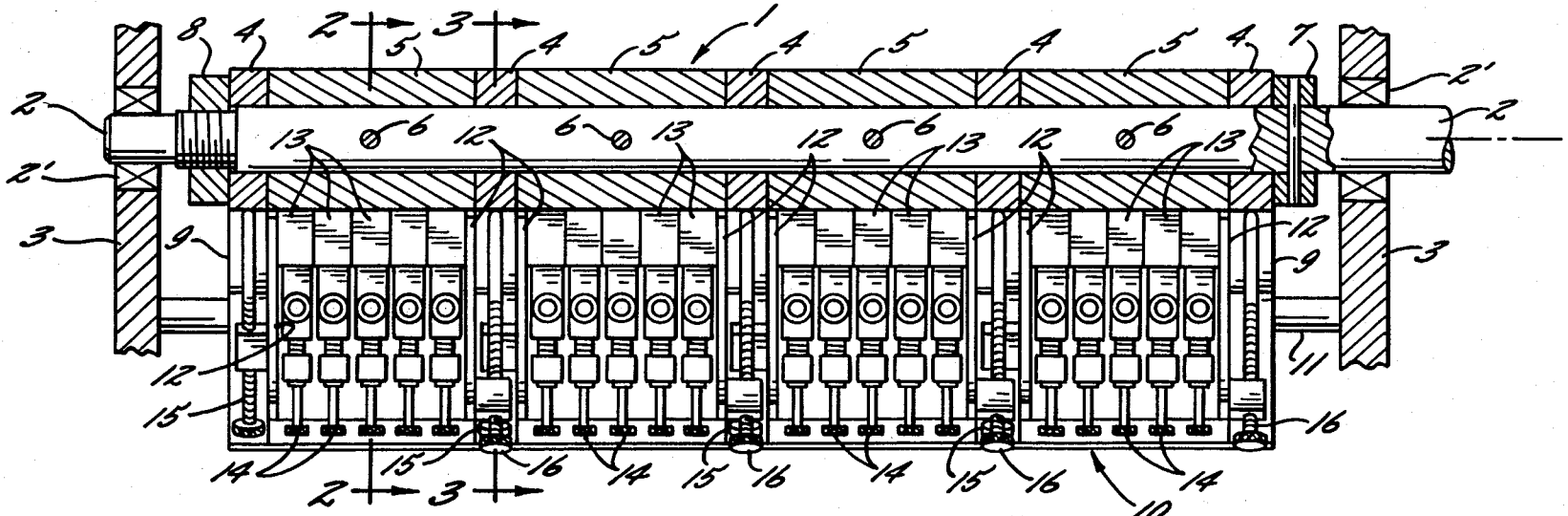
FIG. 1 is a plan view of an inking unit of the invention having four duct segments.

Turning now to the drawings, an inking unit for a printing machine is shown in FIG. 1 including a duct roller 1 having a continuous shaft 2 journalled at both ends in main bearings 2' mounted on the side frames 3 of the printing machine. The duct roller 1 is preferably formed with intermediate bearing rings 4 and tubular duct roll segments 5 pushed on to the shaft 2 in alternate sequence so that they abut one another with the tubular roll segments 5 connected to the shaft 2 by drive pins 6. The intermediate bearing rings 4 and the tubular roll segments 5 are held axially on the shaft 2 by an annular collar 7 secured on one end of the shaft 2 and by a clamp nut 8 screwed on the other end of the shaft 2. The axial play required at the bearing rings 4 can be adjusted by means of the nut 8. Desirably the outside diameters of the intermediate bearing rings 4 and the duct roll segments 5 are substantially equal.

Figure 2:
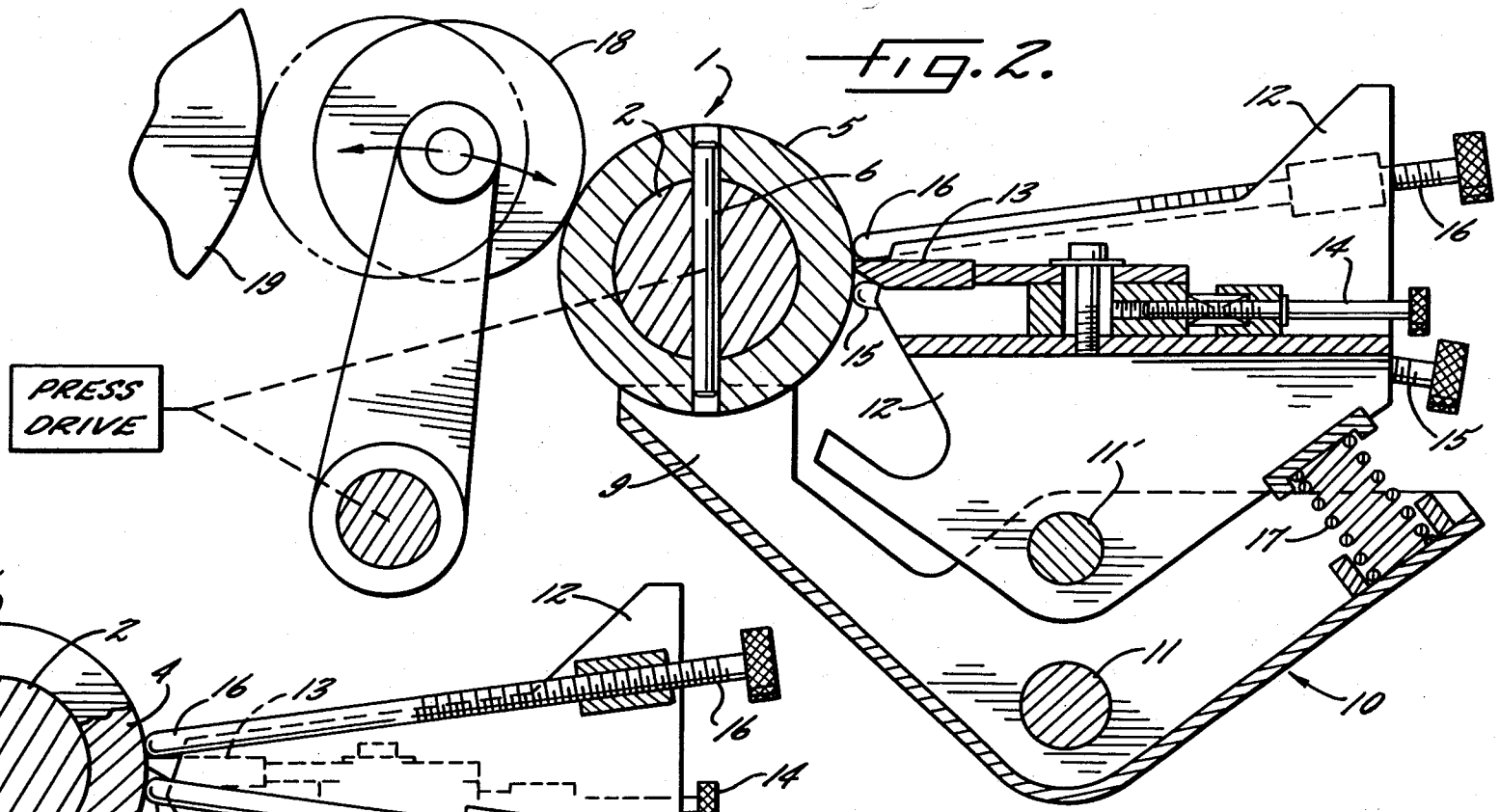
FIG. 2 is an enlarged cross-section through the inking unit shown in FIG. 1, taken substantially along line 2—2.
Figure 3:
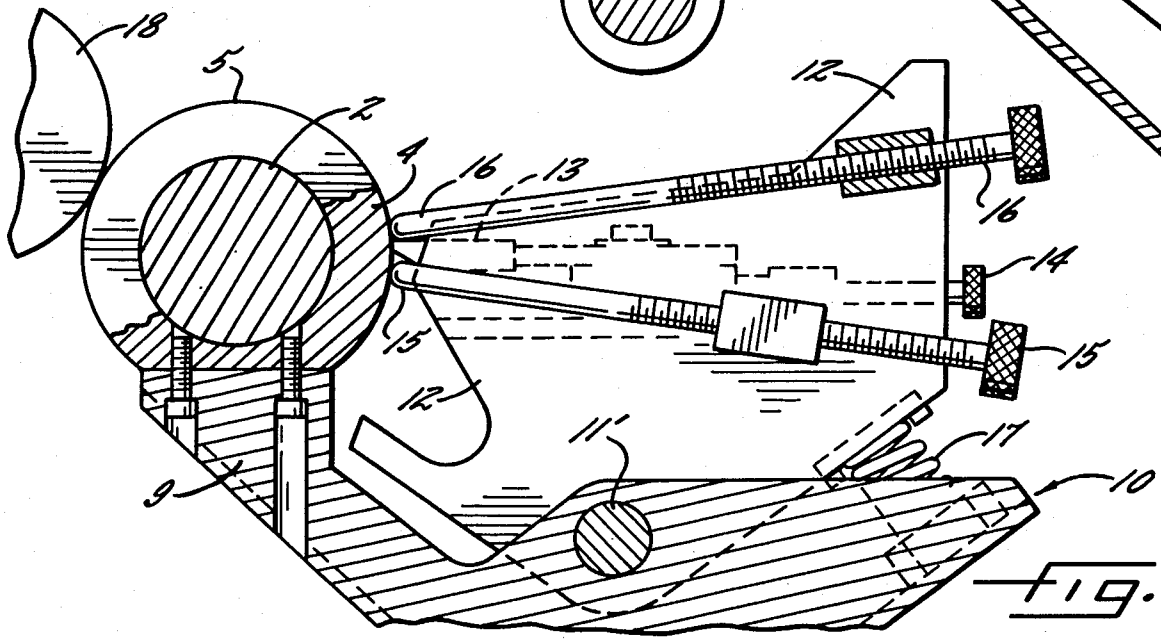
FIG. 3 is an enlarged fragmentary detail of a cross-section of the inking unit according to FIG. 1 taken substantially along line 3—3; and, FIG. 4 is a schematic diagram of an inking unit formed with five duct segment modules.

As shown in FIGS. 2 and 3, vertical webs 9 of a carrier duct 10 are secured to the bearing rings 4, such as by screws. The carrier duct 10 is also held by a cross-member 11 which extends parallel to the duct roller 1 and is secured in the side frames 3 of the printing machine. Between each two webs 9 is a duct segment 12 mounted pivotally on the webs 9 by an intermediate shaft 11' near the cross-member 11. In the illustrated embodiment of FIG. 1, the carrier duct 10 has five webs 9 and can therefore accommodate four pivotally mounted duct segments 12.

Each duct segment 12 carries ink metering elements in the form of slide members 13, and adjusting means 14 by means of which the distance between the individual members 13 and the duct roller 1 can be adjusted independently of one another. The adjusting means 14 may be moved manually or by motor. To hold the members 13 at a predetermined distance from the duct roller 1, the duct segments 12 are supported directly on the bearing rings 4 by way of adjusting screws 15, 16. Engagement of the adjusting screws 15, 16 with the bearing rings 4 is ensured by compression springs 17 clamped between the carrier duct 10 and the duct segments 12.

The adjusting screws 15, 16 are situated at the lateral ends of the duct segments 12 and are situated in approximately the same plane as the members 13. As will be seen from FIG. 3, the adjusting screws 15 and the adjusting screws 16 bear against the bearing ring 4 in slightly circumferentially offset relationship so that the adjacent ends of two duct segments 12 can be supported on one bearing ring 4.

During operation of the printing machine, the duct segments 12 are first brought into a zero position by means of the adjusting screws 15, 16, in which position the end edges of the members 13 bear in parallel relationship against the associated adjacent tubular roll segment 5 of the duct roller 1. The adjusting screws 15, 16 may be moved manually or by motor. The individual members 13 are then adjusted to the required distance from the duct roller 1 to give the required ink profile. The correct adjustment can be obtained without difficulty in accordance with values determined previously by calculation or empirically, since the deflection of the duct roller in the sections between the bearing rings 4 is so slight that it does not affect the adjustment. Even deformation of the duct roller 1 due to variations in operation temperature and changes in the position of the duct roller 1 relative to its mounting in the side frames have no effect on the ink gap adjustment, because the individual duct segments are permanently pressed against the bearing rings by the compression spring 17 and follows the movements of the duct roller 1.

The ink film produced on the duct roller 1 is conventionally transferred by a vibrator 18 to a distributor roller 19. During distribution of the ink in the inking unit the ink-free zones in the region of the bearing rings 4 are equalized.

Figure 4:
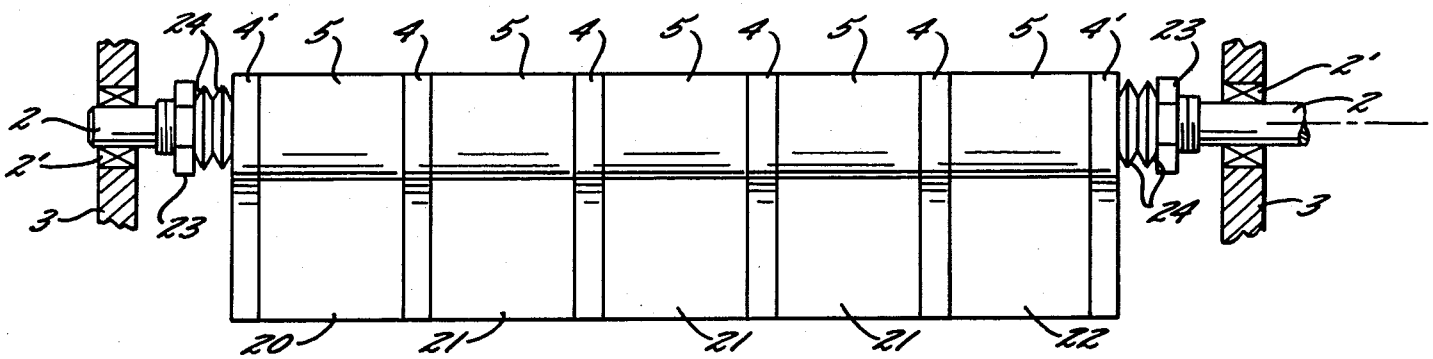

The inking unit construction made up of individual segments gives a modular construction which provides adjustment to printing machines of different widths with little structural outlay. The width of the individual modules is made such that the required machine width at any time can be obtained by adding one or more modules. FIG. 4 illustrates an arrangement of this kind. Here the inking unit consists of a left-hand end module 20, three identical intermediate modules 21, and a right-hand end module 22. If a different width is required, intermediate modules 21 are added or removed.

FIG. 4 also shows an axial mounting of the bearing rings 4, 4' and of the tubular segments 5 on the shaft 2, in which springs or Bellville washers 24 disposed at the two ends of the shaft 2 press the bearing rings 4, 4' and the tubular segments 5 axially against one another so that there is no play. The Bellville washers 24 are clamped between the outer bearing rings 4' and screw nuts 23 screwed to the ends of the shaft 2. The prestressing of the washers 24 can be changed by adjustment of the nuts 23. For accurate location of the position of the bearing rings 4, 4' and of the tubular roll segments 5, the middle tubular segment 5 is connected to the shaft 2 so as to be axially immovable. The advantage of this construction is that thermal expansion can be taken elastically by the compression springs 17 or washers 24 and does not result in clamping of the tubular segments 5 with respect to the bearing rings 4,4'. Also, the middle fixing gives a uniform distribution of the thermal expansion to both sides, so that the maximum displacement, particularly of the outer bearing rings 4', with respect to the machine frame is only half the longitudinal expansion produced by heating.

I claim as my invention:

1. An inking unit for a printing machine comprising, in combination, a duct roller and a duct unit adapted to be set against the duct roller, the duct unit having a plurality of ink metering elements the distance of which from the duct roller can be adjusted independently of one another, characterized in that said duct unit includes a carrier duct mounted directly on the duct roller, a plurality of adjacent duct segments respectively mounted individually for limited pivoting movement on the carrier duct and each duct segment forming an intermediate carrier for at least some of the ink metering elements.

2. An inking unit according to claim 1 wherein the mounting arrangement of the duct segments substantially eliminates the hydrodynamic pressure forces occurring at the duct roller and the ink metering elements during high speed operation.

3. An inking unit according to claim 1, wherein the mounting of the duct segments includes an intermediate pivot shaft constructed so the duct segments individually rock transversely on the intermediate shaft.

4. An inking unit according to claim 1, wherein the duct roller carries bearing rings situated adjacent the lateral ends of the duct segments with the carrier being attached thereto, and the duct segments abut the bearing rings by adjustable stops.

5. An inking unit according to claim 4, including a vibrator roller cooperating with the duct roller and wherein the bearing rings are disposed in grooves in the duct roller and their outside diameters in the region of the vibrator roller and of the ink metering elements do not exceed the outside diameter of the duct roller.

6. An inking unit according to claim 5, wherein the duct roller consists of a continuous shaft and a plurality of tubular segments pushed on to the shaft and connected thereto so as to rotate therewith, each tubular segment cooperating with the ink metering elements of a duct segment and the bearing rings are mounted loosely on the shaft.

7. An inking unit according to claim 6, wherein the axial clearance between the tubular segments and the bearing rings is adjustable by means of a clamp nut screwed to one end of the shaft, said nut cooperating with a shaft collar fixed on the other end of the shaft.

8. An inking unit according to claim 6, wherein a tubular segment disposed on the middle of the shaft is connected to the shaft so as to be axially immovable and compression springs are clamped between the two outer bearing rings and abutment elements adjacent the said rings and secured to the ends of the shaft.

9. An inking unit according to claim 5 wherein compression springs are clamped between the duct segments and the carrier duct and bias the duct segments with the adjustable stops at their lateral ends against the bearing rings of the duct roller.

10. An inking unit according to claim 9, wherein the stops are formed by adjusting screws situated approximately in the same plane as the ink metering elements.

11. An inking unit according to claim 10, wherein the adjusting screws at the adjacent ends of two duct segments bear against the same bearing ring in circumferentially offset relationship.

12. An inking unit according to claim 1, wherein the carrier duct is secured to the side frames of the printing machine by a cross-member extending parallel to the duct roller.

13. An inking unit according to claim 6, wherein the tubular segments of the duct roller, and the duct segments are constructed as matching modules which can be strung together in any desired number to form different inking unit widths.

* * * * *